US012256797B2

(12) United States Patent
Esayian et al.

(10) Patent No.: US 12,256,797 B2
(45) Date of Patent: Mar. 25, 2025

(54) SOFT SHELL HELMET

(71) Applicant: Safer Sports, LLC DBA Light Helmets, Carlsbad, CA (US)

(72) Inventors: Nicholas Esayian, Encinitas, CA (US); Justin Bert, Encinitas, CA (US); Michael Landry, Austin, TX (US)

(73) Assignee: Safer Sports, LLC, Carlsbad, CA (US)

( * ) Notice: Subject to any disclaimer, the term of this patent is extended or adjusted under 35 U.S.C. 154(b) by 97 days.

(21) Appl. No.: 18/344,624

(22) Filed: Jun. 29, 2023

(65) Prior Publication Data

US 2023/0337777 A1 Oct. 26, 2023

Related U.S. Application Data

(63) Continuation of application No. 17/096,202, filed on Nov. 12, 2020, now abandoned.

(60) Provisional application No. 62/939,065, filed on Nov. 22, 2019.

(51) Int. Cl.

| | |
|---|---|
| ***A42B 3/12*** | (2006.01) |
| ***A42B 3/08*** | (2006.01) |
| ***A42B 3/28*** | (2006.01) |
| ***A63B 71/10*** | (2006.01) |

(52) U.S. Cl.

CPC ..... *A42B 3/125* (2013.01); *A42B 3/08* (2013.01); *A42B 3/28* (2013.01); *A63B 71/10* (2013.01)

(58) Field of Classification Search

CPC .. A42B 3/125; A42B 3/08; A42B 3/28; A42B 3/127; A42B 3/00; A63B 71/10

See application file for complete search history.

(56) References Cited

U.S. PATENT DOCUMENTS

| | | | |
|---|---|---|---|
| 3,116,490 | A | 1/1964 | Zbikowski |
| 3,186,004 | A | 6/1965 | Carlini |
| 3,465,363 | A | 9/1969 | Raney |
| 3,720,955 | A | 3/1973 | Rawlings |
| 3,849,801 | A | 11/1974 | Holt et al. |
| 3,906,546 | A | 9/1975 | Gooding |
| 3,935,044 | A | 1/1976 | Daly |
| 3,992,721 | A | 11/1976 | Morton |

(Continued)

FOREIGN PATENT DOCUMENTS

| | | | |
|---|---|---|---|
| CA | 2882688 | A1 | 8/2015 |
| DE | 102017120831 | A1 | 3/2019 |

(Continued)

OTHER PUBLICATIONS

European Patent Office, European Search Report for Application No. EP 20 20 8086, dated Dec. 8, 2021, 11 pages.

(Continued)

*Primary Examiner* — Khaled Annis

(74) *Attorney, Agent, or Firm* — Stetina Garred Brucker & Newboles

(57) ABSTRACT

A helmet includes a shell having an inner surface and an outer surface. The inner surface defines a cavity sized to receive a head of a user. The shell is formed from a resilient material. The helmet additionally includes at least two slots formed in the shell and located at respective lateral portions of the shell, with each slot extending from the outer surface toward the inner surface. The helmet further comprises a chin strap having at least two mounting segments. Each mounting segment is advanceable through a respective one of the at least two slots for connecting the chin strap to the shell.

20 Claims, 6 Drawing Sheets

(56) References Cited

U.S. PATENT DOCUMENTS

| | | | |
|---|---|---|---|
| 4,016,734 | A | 4/1977 | Morton |
| 4,020,507 | A | 5/1977 | Morton |
| 4,023,213 | A | 5/1977 | Rovani |
| 4,044,399 | A | 8/1977 | Morton |
| 4,101,983 | A | 7/1978 | Dera et al. |
| 4,404,690 | A | 9/1983 | Farquharson |
| 4,912,778 | A | 4/1990 | Daniels |
| 4,937,888 | A | 7/1990 | Straus |
| 4,996,724 | A | 3/1991 | Dextrase |
| 5,093,936 | A | 3/1992 | Copeland et al. |
| 5,150,479 | A | 9/1992 | Oleson |
| 5,271,103 | A | 12/1993 | Darnell |
| 5,272,773 | A | 12/1993 | Kamata |
| D361,408 | S | 8/1995 | Ho |
| D361,409 | S | 8/1995 | Ho |
| 5,448,780 | A | 9/1995 | Gath |
| 5,450,631 | A | 9/1995 | Egger |
| 5,829,065 | A | 11/1998 | Cahill |
| 5,915,537 | A | 6/1999 | Dallas et al. |
| 5,940,889 | A | 8/1999 | Shirai |
| 6,032,297 | A | 3/2000 | Barthold et al. |
| 6,073,271 | A | 6/2000 | Alexander et al. |
| 6,154,889 | A | 12/2000 | Moore et al. |
| D439,377 | S | 3/2001 | Dagan |
| 6,219,850 | B1 | 4/2001 | Halstead et al. |
| D452,941 | S | 1/2002 | Ho |
| D465,067 | S | 10/2002 | Ide et al. |
| D466,651 | S | 12/2002 | Halstead et al. |
| 6,604,246 | B1 | 8/2003 | Obreja |
| 6,637,091 | B2 | 10/2003 | Halstead et al. |
| 6,763,524 | B2 | 7/2004 | Halstead et al. |
| 6,934,971 | B2 | 8/2005 | Ide et al. |
| D512,534 | S | 12/2005 | Maddux et al. |
| 7,146,652 | B2 | 12/2006 | Ide et al. |
| 7,240,376 | B2 | 7/2007 | Ide et al. |
| 7,328,462 | B1 | 2/2008 | Straus |
| D581,599 | S | 11/2008 | Ferrara et al. |
| D582,607 | S | 12/2008 | Ferrara et al. |
| D587,853 | S | 3/2009 | Nimmons |
| D603,099 | S | 10/2009 | Bologna et al. |
| 7,676,854 | B2 | 3/2010 | Berger et al. |
| D625,050 | S | 10/2010 | Chen |
| 7,841,025 | B1 | 11/2010 | Fink et al. |
| D629,162 | S | 12/2010 | Daniel |
| D638,586 | S | 5/2011 | Aaskov et al. |
| 7,954,177 | B2 | 6/2011 | Ide et al. |
| D654,628 | S | 2/2012 | Aris et al. |
| D654,630 | S | 2/2012 | Chou et al. |
| 8,347,419 | B1 | 1/2013 | Cleva |
| D678,617 | S | 3/2013 | Erb et al. |
| D679,452 | S | 4/2013 | Powell |
| D681,280 | S | 4/2013 | Bologna et al. |
| D681,281 | S | 4/2013 | Bologna et al. |
| 8,499,366 | B2 | 8/2013 | Nimmons et al. |
| 8,528,118 | B2 | 9/2013 | Ide et al. |
| D696,463 | S | 12/2013 | Simpson |
| 8,615,817 | B2 | 12/2013 | Phillips |
| D697,270 | S | 1/2014 | Simpson |
| D699,895 | S | 2/2014 | Hill et al. |
| 8,640,267 | B1 | 2/2014 | Cohen |
| D708,395 | S | 7/2014 | Larocque |
| D708,792 | S | 7/2014 | Aaskov et al. |
| 8,782,819 | B1 | 7/2014 | Culpepper |
| 8,813,269 | B2 | 8/2014 | Bologna et al. |
| 8,863,320 | B2 | 10/2014 | Kelly et al. |
| 8,938,818 | B2 | 1/2015 | Ide et al. |
| 8,955,169 | B2 | 2/2015 | Weber et al. |
| D752,821 | S | 3/2016 | Bologna |
| 9,289,024 | B2 | 3/2016 | Withnall et al. |
| D764,716 | S | 8/2016 | Bologna |
| RE46,249 | E | 12/2016 | LaRocque |
| D774,257 | S | 12/2016 | Larocque |
| 9,572,390 | B1 | 2/2017 | Simpson |
| 9,603,408 | B2 | 3/2017 | Simpson |
| D794,253 | S | 8/2017 | Marting et al. |
| 9,775,394 | B2 | 10/2017 | Dagan |
| D803,483 | S | 11/2017 | Bologna |
| 9,820,525 | B2 | 11/2017 | Weber et al. |
| D805,255 | S | 12/2017 | Hefer et al. |
| D812,308 | S | 3/2018 | Hall et al. |
| D812,309 | S | 3/2018 | Nellestam et al. |
| D827,207 | S | 8/2018 | Garcia Mansilla et al. |
| 10,136,692 | B2 | 11/2018 | Ide et al. |
| 10,143,257 | B2 | 12/2018 | Ide et al. |
| 10,201,743 | B1 | 2/2019 | Simpson |
| 10,271,605 | B2 | 4/2019 | Withnall et al. |
| D850,011 | S | 5/2019 | Bologna et al. |
| D850,012 | S | 5/2019 | Bologna et al. |
| D850,013 | S | 5/2019 | Bologna et al. |
| D856,600 | S | 8/2019 | Withnall et al. |
| D856,601 | S | 8/2019 | Bologna et al. |
| D869,098 | S | 12/2019 | Hall et al. |
| 10,542,788 | B2 | 1/2020 | Simpson |
| 2001/0011388 | A1 | 8/2001 | Nelson et al. |
| 2002/0068152 | A1 | 6/2002 | Heath et al. |
| 2002/0120978 | A1 | 9/2002 | Moore, III |
| 2004/0025231 | A1 | 2/2004 | Ide et al. |
| 2005/0278834 | A1 | 12/2005 | Lee |
| 2006/0117466 | A1 | 6/2006 | Abelman et al. |
| 2006/0123526 | A1 | 6/2006 | Lim |
| 2007/0000032 | A1 | 1/2007 | Morgan |
| 2008/0022441 | A1 | 1/2008 | Oranchak et al. |
| 2009/0222964 | A1 | 9/2009 | Wiles |
| 2010/0000009 | A1 | 1/2010 | Morgan |
| 2010/0171349 | A1 | 7/2010 | Dellanno |
| 2010/0180362 | A1 | 7/2010 | Glogowski et al. |
| 2010/0180363 | A1 | 7/2010 | Glogowski et al. |
| 2010/0186150 | A1 | 7/2010 | Ferrara et al. |
| 2010/0258988 | A1 | 10/2010 | Darnell et al. |
| 2011/0061154 | A1 | 3/2011 | Turner et al. |
| 2011/0277226 | A1 | 11/2011 | Turner |
| 2011/0296594 | A1 | 12/2011 | Thomas et al. |
| 2012/0005810 | A1 | 1/2012 | Cheng |
| 2012/0017358 | A1 | 1/2012 | Princip et al. |
| 2012/0036620 | A1 | 2/2012 | Harris |
| 2012/0047635 | A1 | 3/2012 | Finiel et al. |
| 2012/0052249 | A1 | 3/2012 | Turner |
| 2012/0060251 | A1 | 3/2012 | Schimpf |
| 2012/0216327 | A1 | 8/2012 | Turner |
| 2012/0233745 | A1 | 9/2012 | Veazie |
| 2013/0061375 | A1 | 3/2013 | Bologna et al. |
| 2013/0340146 | A1 | 12/2013 | Dekker et al. |
| 2014/0007324 | A1 | 1/2014 | Svehaug |
| 2014/0020158 | A1 | 1/2014 | Parsons et al. |
| 2014/0196198 | A1 | 7/2014 | Cohen |
| 2015/0223546 | A1 | 8/2015 | Cohen |
| 2015/0320134 | A1 | 11/2015 | Stolker |
| 2016/0015111 | A1 | 1/2016 | Latruffe |
| 2016/0316847 | A1 | 11/2016 | Weber et al. |
| 2018/0070667 | A1 | 3/2018 | Weber et al. |
| 2019/0098954 | A1 | 4/2019 | Ide et al. |
| 2019/0216155 | A1 | 7/2019 | Zents |
| 2019/0254378 | A1 | 8/2019 | Withnall et al. |
| 2021/0153592 | A1 | 5/2021 | Esayian et al. |

FOREIGN PATENT DOCUMENTS

| | | | |
|---|---|---|---|
| NL | 2005798 | C2 | 6/2012 |
| WO | 8501665 | A1 | 4/1985 |
| WO | 2014019537 | A1 | 2/2014 |

OTHER PUBLICATIONS

Durocher Jacques, Adjustable Helmet, WO-2019100153-A1, May 31, 2019 (Year: 2019).

Mangold M, Helmet, DE-102017120831-A1, Mar. 14, 2019 (Year: 2019).

Gaudierre A, Multi-material Protective Helmet, CN106880123B, Dec. 5, 2016 (filed date) (Year: 2016).

SOFT SHELL HELMET

CROSS-REFERENCE TO RELATED APPLICATIONS

This application is a continuation of U.S. application Ser. No. 17/096,202, filed Nov. 12, 2020, which claims the benefit of U.S. Provisional Application No. 62/939,065, filed Nov. 22, 2019, the contents of which are expressly incorporated herein by reference.

STATEMENT RE: FEDERALLY SPONSORED RESEARCH/DEVELOPMENT

Not Applicable

BACKGROUND

1. Technical Field

The present disclosure relates generally to a helmet, and more specifically to a soft shell helmet including a resilient shell, a chin strap, and a pair of lateral pads coupled to the chin strap and positionable adjacent the resilient shell.

2. Description of the Related Art

When an individual's head is subjected to a large impact force, the impact may result in a concussion or other brain injury. Recent advancements in medical technology have allowed for a deeper understanding of the long-lasting impacts of concussions, which has in turn led to a growing concern for those who experience a concussion. The physical nature of sports, such as football, rugby, and soccer, to name a few, coupled with the recent advancements in medical technology, has resulted in significant medical concerns for those participating in such physical activities.

With regard specifically to the sport of football, helmets are commonly worn by football players to provide protection against head injury resulting from impact with another player, impact with the ground, or impact with objects near the playing field. A conventional football helmet may include a rigid outer shell formed from a plastic material, an inner liner made from a shock absorbing material, a face guard and a chin strap.

While conventional football helmets may be suitable for full-contact football, less physical variants of football, such as flag-football leagues or passing leagues may not require such cumbersome helmets. Indeed, conventional football helmets may be associated with considerable weight and size, which may lead to discomfort when worn. Furthermore, in flag-football leagues or passing leagues, the players may not be wearing the same amount of protective gear as is worn in conventional football, and thus, a conventional football helmet may cause harm and injury to other players.

Other sports, such as soccer or rugby, have traditionally not required helmets by its participants, although head injuries are not uncommon in those sports. However, to date, protective head gear has not been developed which has found widespread adoption in those sports, despite the frequency of head injuries.

Accordingly, there is a need in the art for a comfortable, lightweight, helmet that may provide impact protection to the head of a wearer. Various aspects of the present disclosure address this particular need, as will be discussed in more detail below.

BRIEF SUMMARY

In accordance with one embodiment of the present disclosure, there is provided a helmet comprising a shell having an inner surface and an outer surface. The inner surface defines a cavity sized to receive a head of a user. The shell is formed from a resilient material. The helmet additionally includes at least two slots formed in the shell and located at respective lateral portions of the shell, with each slot extending from the outer surface toward the inner surface. The helmet further comprises a chin strap having at least two mounting segments. Each mounting segment is advanceable through a respective one of the at least two slots for connecting the chin strap to the shell.

The resilient material used to form the shell may be expanded polypropylene (EPP) foam. The EPP foam may be of a density between 1.5-2.5 pound-force per cubic foot (pcf). The outer surface of the shell may be exposed and formed from the EPP foam.

The helmet may additionally include a pair of lateral pads connected to respective sides of the chin strap. Each lateral pad may be formed from Ethylene-vinyl acetate (EVA) foam. Each lateral pad may include a central opening formed therein. Each lateral pad may further comprise a peripheral sidewall, a portion of which is complementary in shape to a surface contour defined by the shell.

Each mounting segment may include a distal portion and a proximal portion. The distal portion may be advanceable through the slot and engageable with the proximal portion to connect the chin strap to the shell.

The helmet may include at least one vent opening formed in the shell.

The helmet may additionally comprise at least one inner pad connectable to the inner surface of the shell.

Each slot extend may extend from the outer surface to the inner surface.

According to another embodiment, there is provided a helmet comprising a shell formed of a resilient material. The shell includes an inner surface, an outer surface, and a pair of lateral edges, each defining a lateral contour. The helmet further includes a chin strap connectable to the shell. A pair of lateral pads are connected to the chin strap in opposed relation to each other. Each lateral pad includes a mating edge that is complementary in shape to the lateral contour of a respective one of the pair of lateral edges.

The lateral contour of the shell may be of a concave configuration, and the mating edge of each lateral pad may be of a convex configuration.

The chin strap may include a pair of mounting segments. Each mounting segment may include a distal portion and a proximal portion. The distal portion may be advanceable through the slot and engageable with the proximal portion to connect the chin strap to the shell.

According to another embodiment, there is provided a helmet comprising a resilient shell having an inner surface, an outer surface, a first lateral portion, and a second lateral portion. The inner surface defines a cavity sized to receive a head of a user. The helmet additionally includes a chin strap assembly connectable to the resilient shell. The chin strap assembly includes a first strap body connectable to the first lateral portion of the resilient shell. A second strap body is connectable to the second lateral portion of the resilient shell, with the second strap body being selectively engageable with the first strap body. A first lateral pad is connected to the first strap body such that connection of the first strap body to the first lateral portion of the resilient shell positions the first lateral pad adjacent the first lateral portion of the resilient shell. A second lateral pad is connected to the second strap body, such that connection of the second strap body to the second lateral portion of the resilient shell positions the second lateral pad adjacent the second lateral portion of the resilient shell.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

Figure 1:
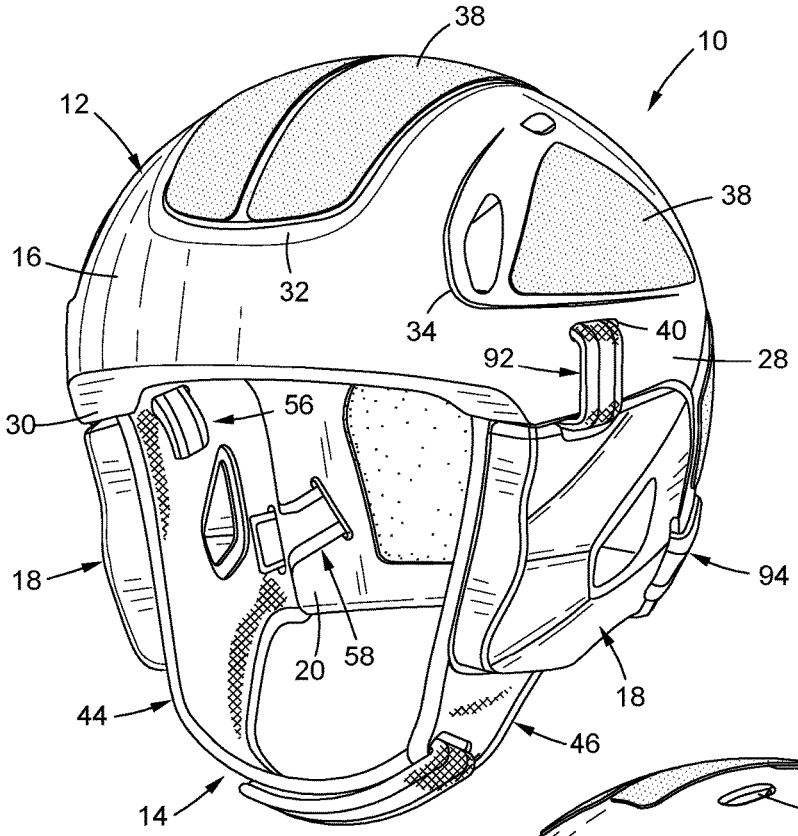
FIG. 1 is a front upper perspective view of a soft-shell helmet according to one embodiment of the present disclosure.
Figure 2:
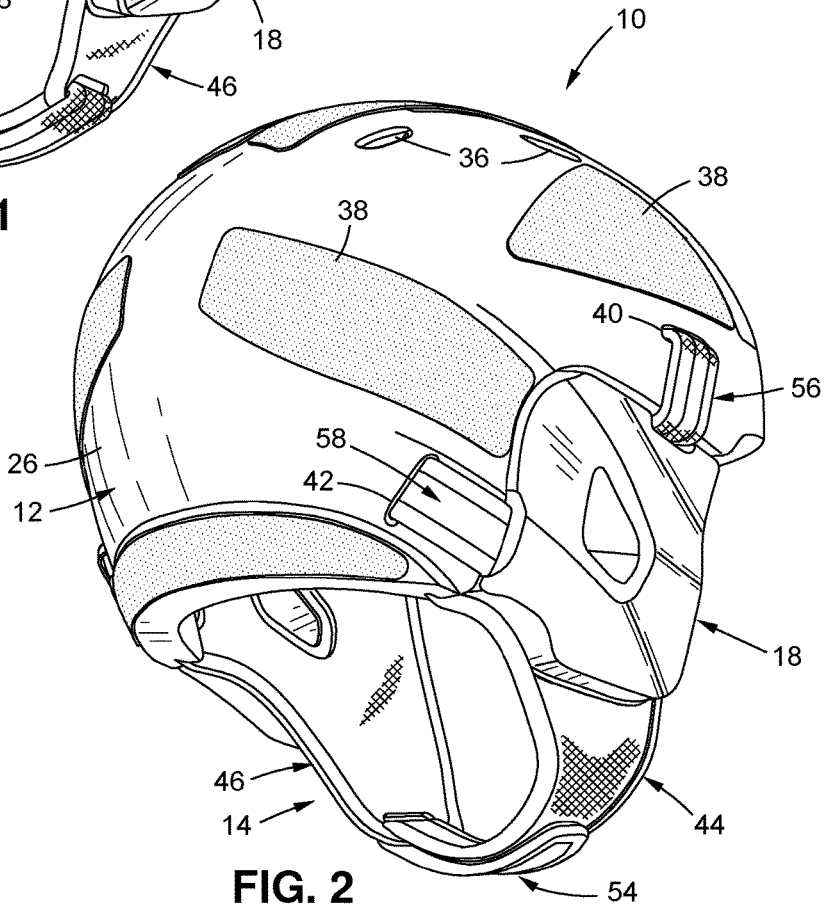
FIG. 2 is a rear lower perspective view of the soft-shell helmet depicted in FIG. 1.
Figure 3:
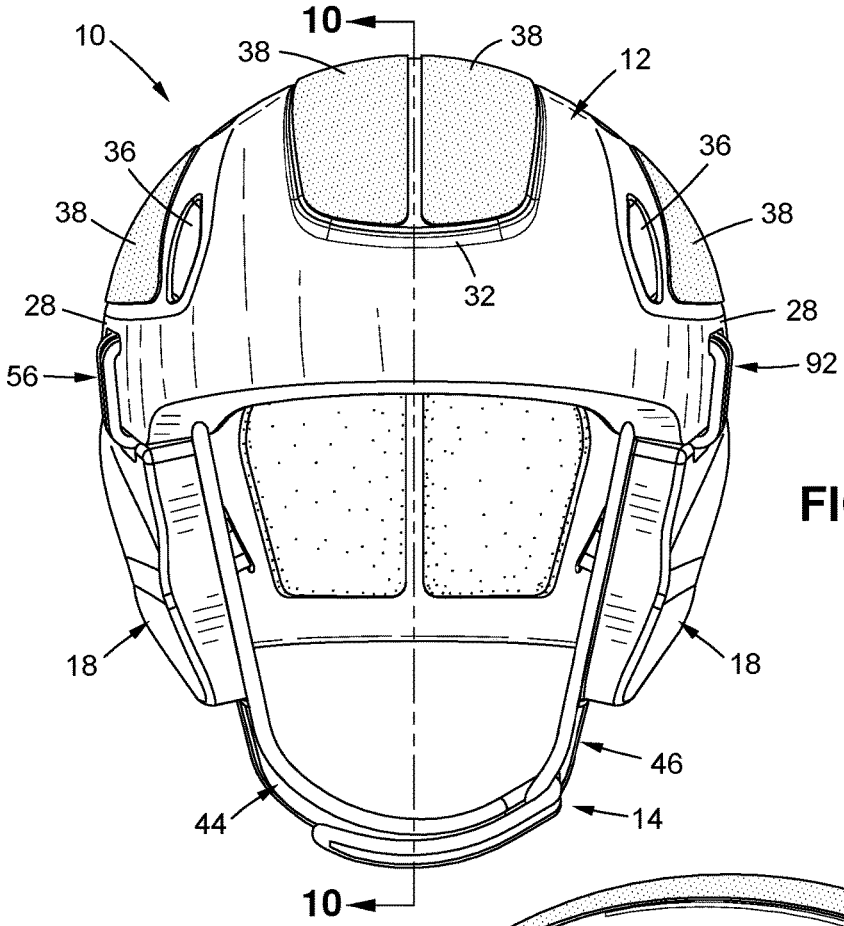
FIG. 3 is a front view of the soft-shell helmet depicted in FIG. 1.

The detailed description set forth below in connection with the appended drawings is intended as a description of certain embodiments of a soft shell helmet and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

According to various aspects of the present disclosure, there is provided a soft-shell helmet 10 generally comprised of a resilient cushioned shell 12 and a chin strap assembly 14 selectively attachable to the shell 12, with the shell 12 including an exposed foam outer surface 16. The chin strap assembly 14 may include lateral pads 18 integrated therein and may be configured such that the lateral pads 18 may be positioned on opposed sides of the helmet 10 when the chin strap assembly 14 is connected to the shell 12. Furthermore, most, if not all, of the materials used in constructing the helmet 10 may be soft and lightweight to provide for a very comfortable, yet protective, fit for a wearer. As such, the helmet 10 may be particularly suitable for use in less physical forms of football, such as passing leagues, flag football leagues, etc., or other sports, such as rugby or soccer to provide protection against head impacts.

The shell 12 may include an inner surface 20, the outer surface 16, a front region 22, a top region 24, a back region 26, and a pair of opposed side/lateral regions 28. The shell 12 may additionally include a bottom surface 30 extending between the inner surface 20 and the outer surface 16. The outer surface 16 may include a generally U-shaped channel 32 having a pair of lateral segments and a forward segment extending between the pair of lateral segments. The lateral segments may be generally parallel to each other, or alternatively, may define a non-parallel configuration. For instance, the lateral segments may spread apart from each other as they extend away from the forward segment. The forward segment may be linear and extend between the pair of lateral segments, or alternatively, the forward segment may be slightly arcuate. The channel 32 may enhance the outward appearance of the shell 12, while also provide a boundary for placement of optional decals on the shell 12.

The outer surface 16 may also include a pair of lateral edges 34 that separate adjacent regions of the outer surface 16. Each lateral edge 34 may include an upper segment and a side segment extending rearwardly from the upper segment. The junction of the upper segment and the side segment may define a corner.

The helmet 10 may additionally include one or more openings 36 formed therein. The openings 36 may be complete openings, which may extend completely between the outer surface 16 and the inner surface 20, or partial openings, which may extend only partially between the outer surface 16 and the inner surface 20. The openings 36 may be arranged in a pair of arrays, wherein each array is positioned on a respective side of the channel 32. Furthermore, a forward-most opening 36 in each array may be positioned adjacent the corner of the lateral edge 34.

The channel(s) 32 and openings 36 may provide for a reduction in material used in forming the shell 12, resulting in a lighter overall weight, without compromising the structural integrity of the shell 12. Furthermore, in the case of complete openings, the ventilation provided to a user wearing the shell 12 may be enhanced.

The inner surface 20 of the shell 12 may define a cavity that is sized to receive the head of a user. In this regard, when the helmet 10 is worn by the user, the shell 12 may extend over the top of the wearer's head and may extend in a forward direction to cover an upper portion of the wearer's forehead. The shell 12 may not extend over the wearer's eyes, and thus, may provide clearance over the wearer's face. In this regard, the shell 12 may be configured for use without a facemask. The shell 12 may extend in a rearward direction toward the wearer's neck to cover the back of the wearer's head.

In one particular embodiment, the shell 12 may be formed from expanded polypropylene (EPP) foam. The EPP foam may be of a density between 1.5-2.5 pound-force per cubic foot (pcf), and in one particular embodiment, the density may be 1.9 pcf. However, it is understood that other densities may be used without departing from the spirit and scope of the present disclosure. Furthermore, it is contemplated that resilient cushioned materials other than EPP foam may also be used to fabricate the shell 12 without departing from the spirit and scope of the present disclosure. Such materials may include other polymer materials, other foam materials, as well as other non-foam materials currently known or later developed that may exhibit desired resiliency or force absorbing characteristics.

The shell 12 may be formed from a pressure molding procedure, which may result in the shell 12 being a unitary structure. In this regard, the shell 12 may be configured such that the outer surface 16 thereof may be exposed and formed from the EPP foam. No outer liners or covers may be required. However, it is understood that outer liners and covers may be used without departing from the spirit and scope of the present disclosure. Furthermore, external decals 38 may also be used and placed over prescribed regions of the outer surface 16 of the shell 12, including those regions shown in the Figures, as well as other regions, such as in the front-center of the shell 12 (e.g., the forehead area), as well as the back-center-bottom of the shell 12. Any outer layer, cover, or decal 38 may be used to identify the helmet 10 as being associated with a particular team, group, or individual. For instance, the outer layer, cover, or decal 38 may include prescribed team colors, names, or logos. It is also contemplated that team names, logos, user names, etc. may be molded directly into the outer surface 16 of the shell 12.

Figure 4:
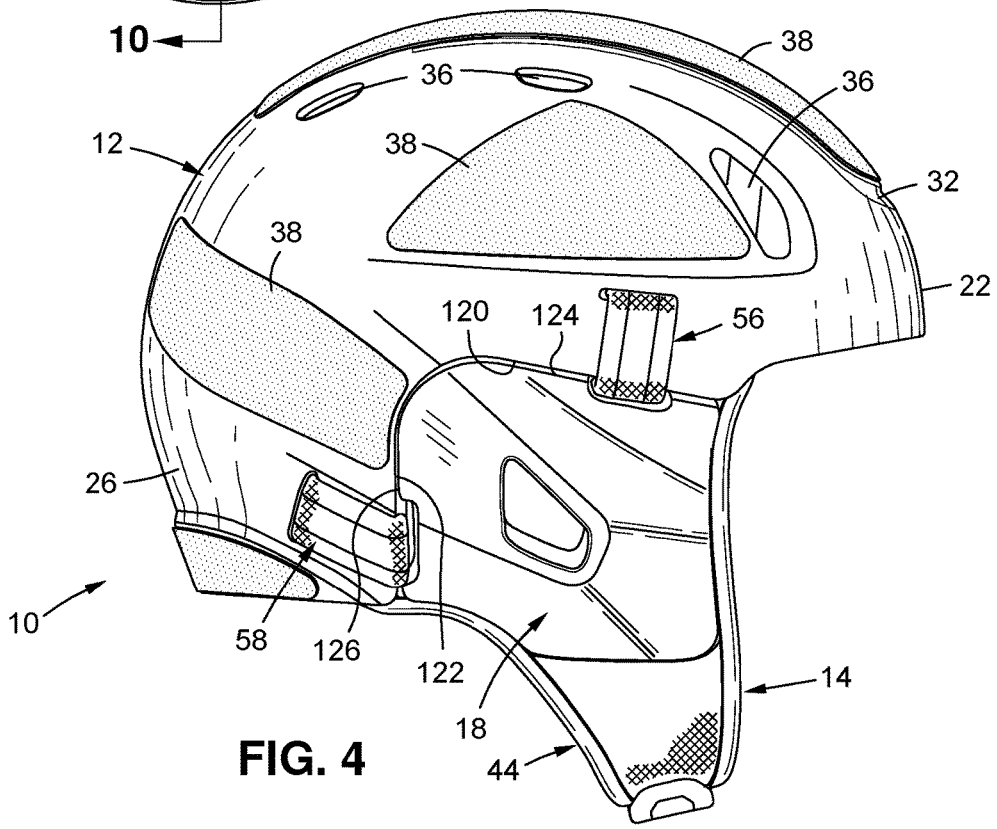
FIG. 4 is a first side view of the soft-shell helmet depicted in FIG. 1.
Figure 5:
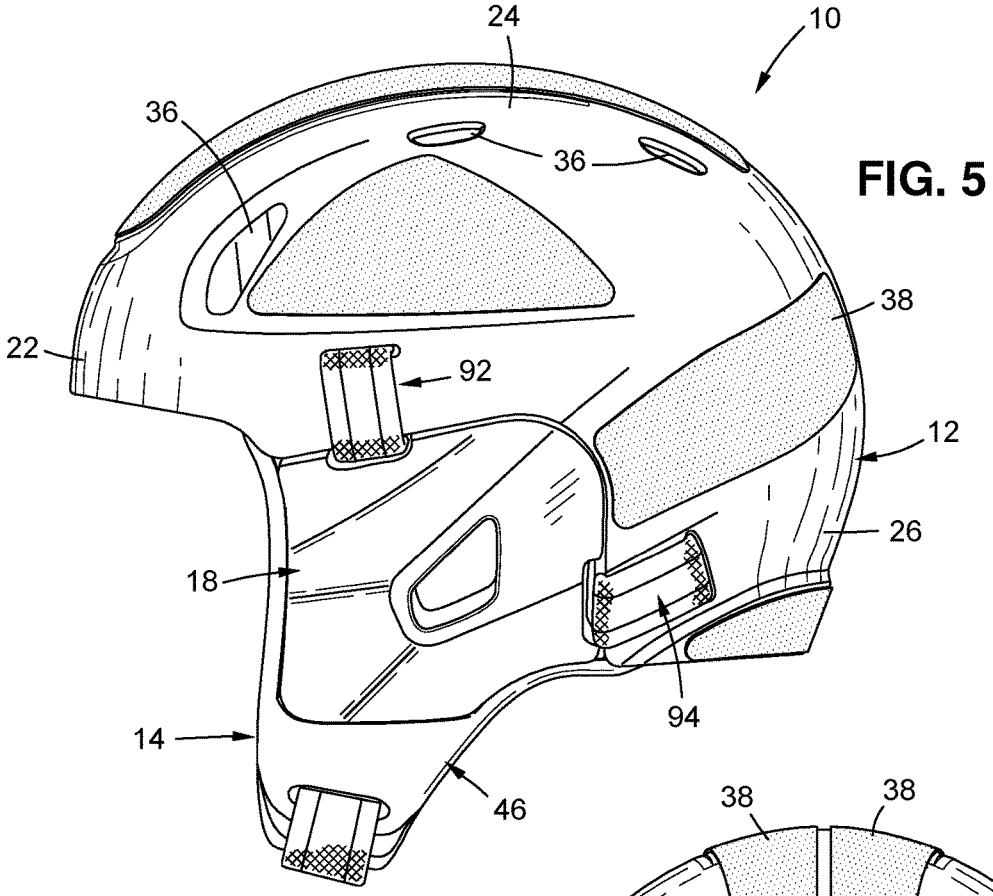
FIG. 5 is a second side view of the soft-shell helmet depicted in FIG. 1.
Figure 6:
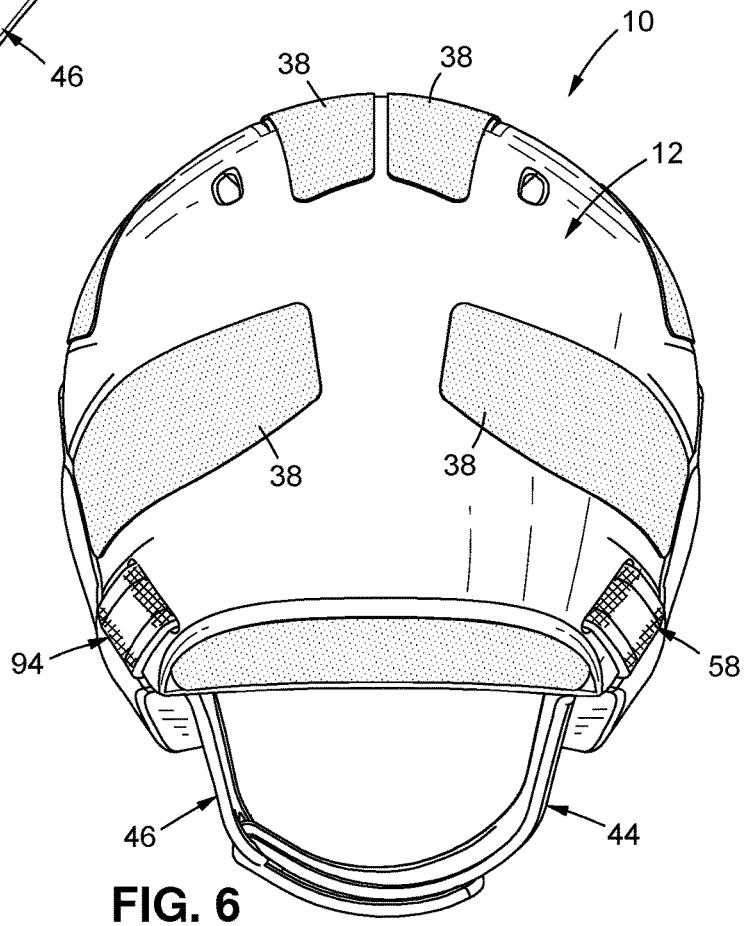
FIG. 6 is a rear view of the soft-shell helmet depicted in FIG. 1.
Figure 7:
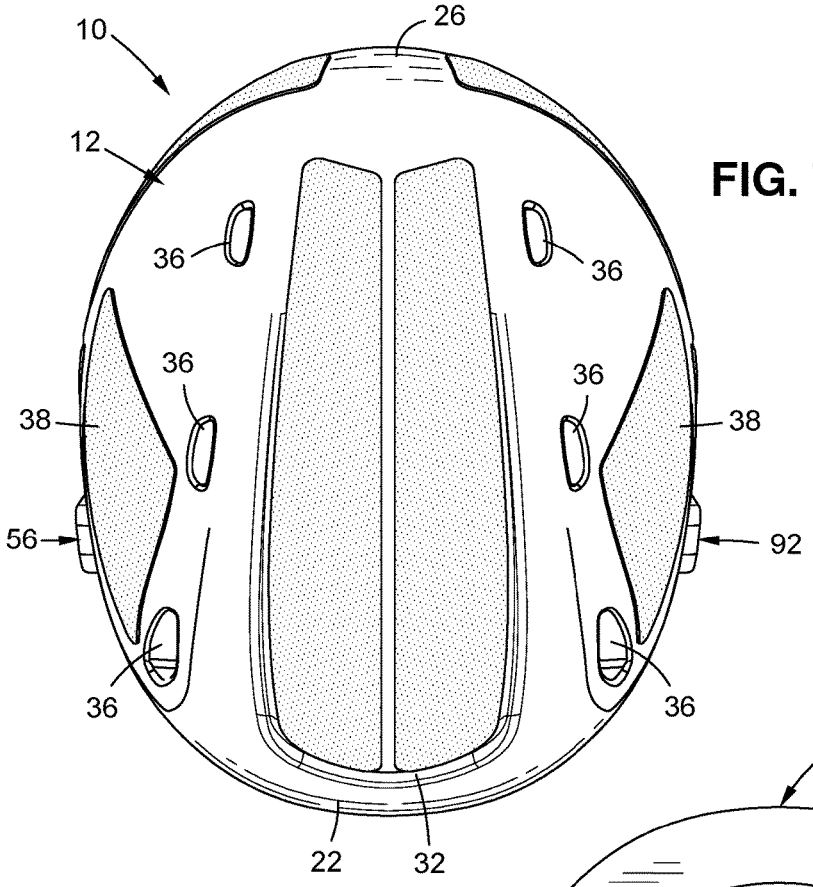
FIG. 7 is a top view of the soft-shell helmet depicted in FIG. 1.
Figure 8:
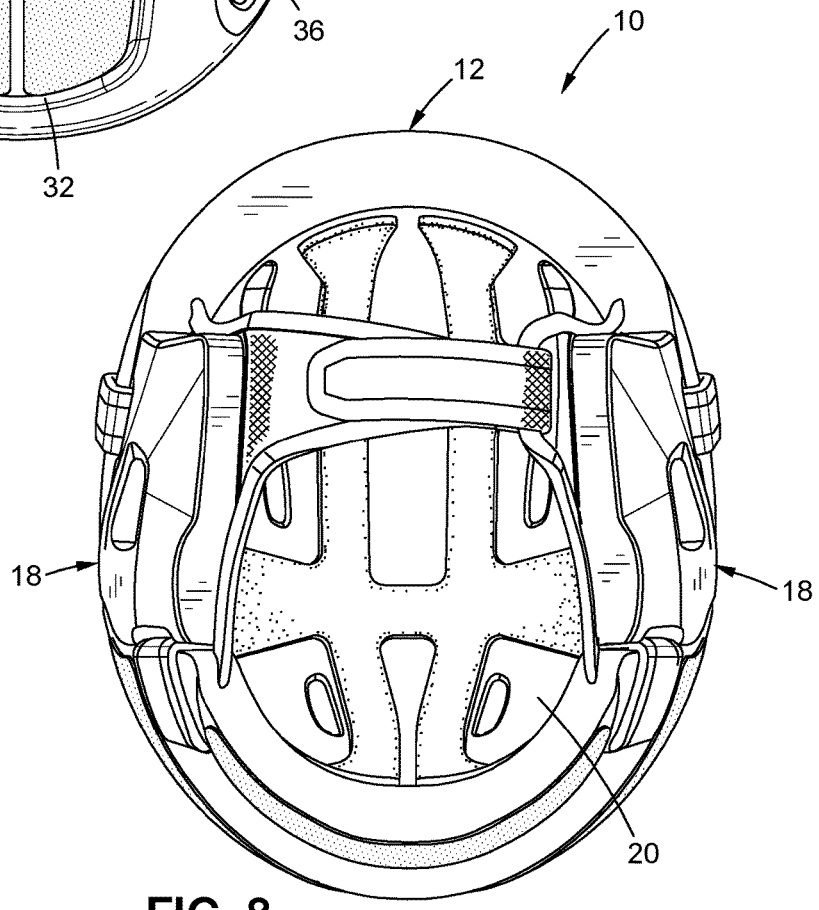
FIG. 8 is a bottom view of the soft-shell helmet depicted in FIG. 1.
Figure 9:
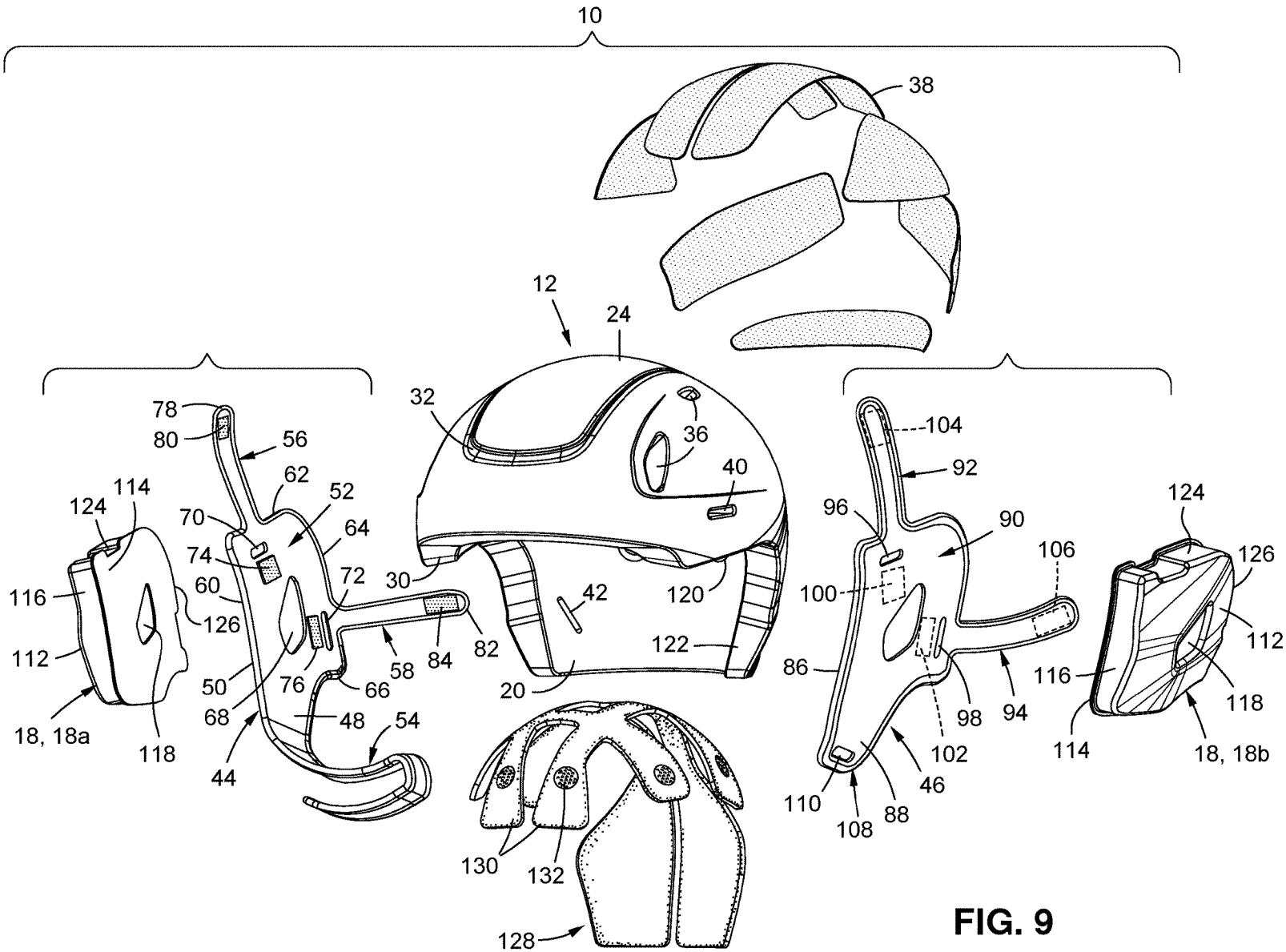
FIG. 9 is an exploded view of the soft-shell helmet depicted in FIG. 1.
Figure 10:
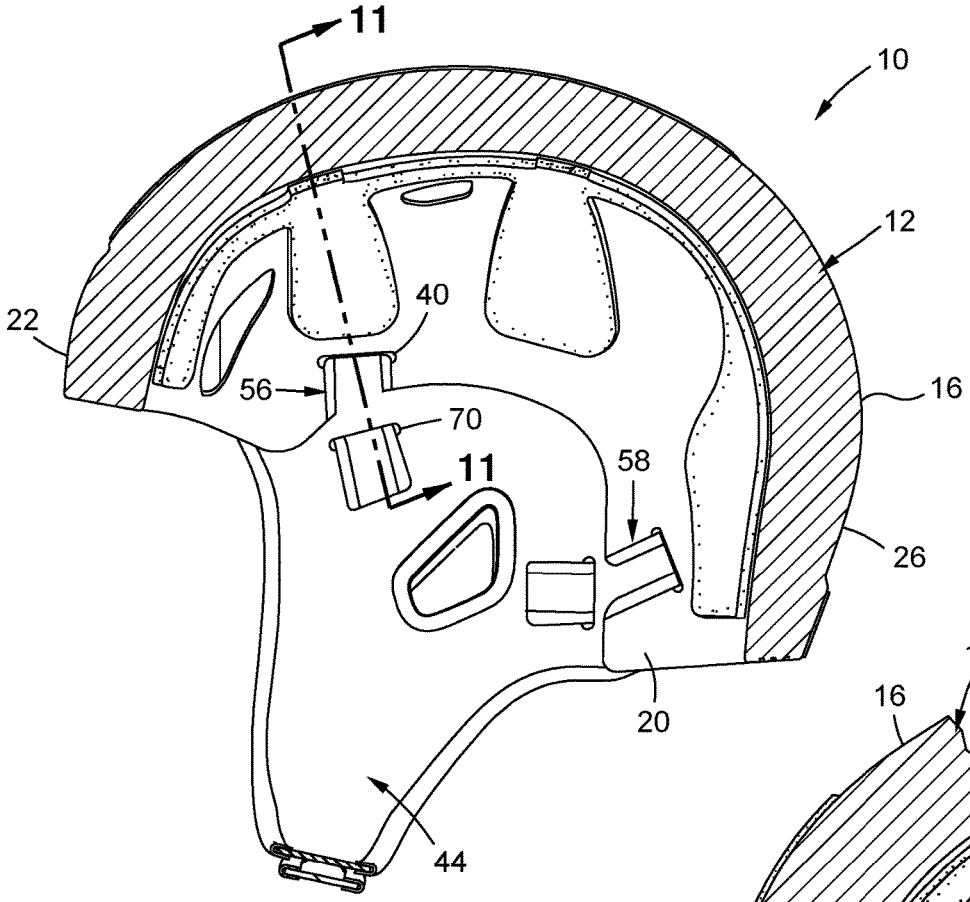
FIG. 10 is a cross-sectional view of the soft-shell helmet.
Figure 11:
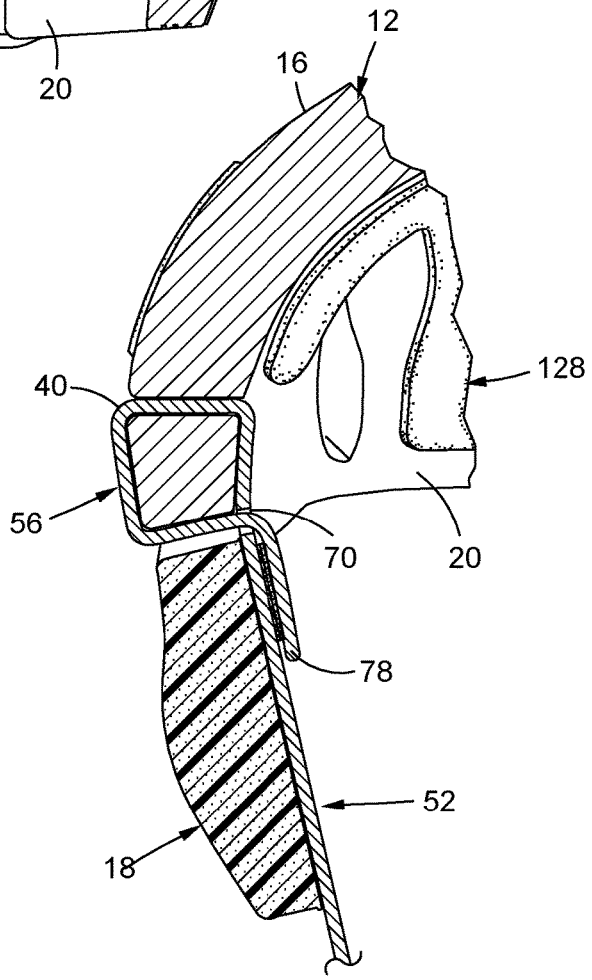
FIG. 11 is an enlarged cross-sectional view of the helmet depicted in FIG. 10.

As noted above, the shell 12 may be specifically configured and adapted for use with the chin strap assembly 14. Accordingly, to facilitate engagement with the chin strap assembly 14, one embodiment of the shell 12 includes a pair of forward mount slots 40 and a pair of rearward mount slots 42. Each mount slot 40, 42 may extend completely from the outer surface 16 to the inner surface 20. The forward mount slots 40 may be located an upper, forward portion of the shell 12, while the rearward mount slots 42 may be located a lower, rearward portion of the shell 12. Each slot 40, 42 may be spaced from the bottom surface 30 and may extend longitudinally in a direction that is generally parallel to an adjacent portion of the bottom surface 30. When viewed from the perspectives shown in FIGS. 4 and 5, the forward mount slot 40 extends along a first axis and the second mount slot 42 extends along a second axis that approximately forms a ninety degree angle relative to the first axis. The actual magnitude of such angle may vary, such as between 60-120 degrees. Each mount slot 40, 42 may be sized and structured to accept a respective portion of the chin strap assembly 14 for attaching the chin strap assembly 14 to the shell 12, as will be described in more detail below.

According to one embodiment, the chin strap assembly 14 includes a first strap body 44 connectable to a first side region of the shell 12 and a second strap body 46 connectable to a second side region of the shell 12. The first and second strap bodies 44, 46 are also configured to be selectively engageable to each other. The first and second strap bodies 44, 46 may be formed from polypropylene, nylon, or other materials known in the art. An inner surface of the first and second strap bodies 44, 46 may be lined with a moisture wicking material for comfort during use.

The first strap body 44 includes an inner surface 48 and an opposing outer surface 50, and is comprised of a primary panel 52, a chin strap segment 54, a first mounting segment 56, a second mounting segment 58. The primary panel 52 includes a forward edge 60, a top edge 62, a rearward edge 64, and a bottom edge 66. The primary panel 52 includes a central ear opening 68 extending between the inner and outer surfaces 48, 50. The configuration of the central ear opening 68 may be non-circular. In the exemplary embodiment, the central ear opening 68 is four-sided, although other shapes and sizes may be used without departing from the spirit and scope of the present disclosure. The primary panel additionally includes a first mounting slot 70 and a second mounting slot 72. The first mounting slot 70 is positioned adjacent the top edge 62 and extends in generally parallel relation thereto. The second mounting slot 72 is positioned adjacent the rearward edge 64 and extends in generally parallel relation thereto. The purposes of the first and second mounting slots 70, 72 will be explained in more detail below. A first hook and loop fastening strip 74 may be coupled to the inner surface 48 of the primary panel 52 adjacent the first mounting slot 70 and a second hook and loop fastening strap 76 may be coupled to the inner surface 48 of the primary panel 52 adjacent the second mounting slot 72.

The first mounting segment 56 is a finger-like extension extending from the top edge 62 of the primary panel 52. The first mounting segment 56 includes a distal portion 78 extending away from the primary panel 52, which may be considered a proximal portion of the first mounting segment 56. The inner surface 48 of the first mounting segment 56 may include a third hook and loop fastening strip 80 complementary to the first hook and loop fastening strip 74.

The second mounting segment 58 is a finger-like extension extending from the rearward edge 64 of the primary panel 52. The second mounting segment 58 includes a distal portion 82 positioned away from the primary panel 52 (e.g., the proximal portion). The inner surface 48 of the second mounting segment 58 may include a fourth hook and loop fastening strip 84 complementary to the second hook and loop fastening strip 76.

To connect the first strap body 44 to the shell 12, the distal portion 78 of the first mounting segment 56 is advanced through a forward mount slot 40 on the shell 12 from the inner surface 20 of the shell 12 toward the outer surface 16 of the shell 12. The distal portion 78 is then extended over the outer surface 16 of the shell 12, and then along the bottom surface 30 of the shell 12. The first mounting slot 70 on the first strap body 44 is positioned adjacent the bottom surface 30, and the distal portion 78 is advanced through the first mounting slot 70. The distal portion 78 is then extended over a portion of the primary panel 52 to create overlap between the distal portion 78 and the primary panel 52. The overlap allows the first and third hook and loop fastening strips 74, 80 to be engaged with each other.

In addition to the foregoing, connection of the first strap body 44 to the shell 12 may further include advancement of the distal portion 82 of the second mounting segment 58 through a rearward mount slot 42 on the shell 12 from the inner surface 20 of the shell 12 toward the outer surface 16 of the shell 12. The distal portion 82 of the second mounting segment 58 is then extended over the outer surface 16 of the shell 12, and then along the bottom surface 30 of the shell. The second mounting slot 72 on the first strap body 44 is positioned adjacent the bottom surface 30, and the distal portion 82 of the second mounting segment 58 is advanced through the second mounting slot 72. The distal portion 82 is then extended over the primary panel 52 to create overlap between the distal portion 82 and the primary panel 52, such that the second and fourth hook and loop fastening strips 76, 84 can be engaged with each other.

When both the first and second mounting segments 56, 58 are advanced through their respective slots 40, 42 on the shell 12 and the slots 70, 72 on the first strap body 44, and connected to the primary panel 52, the first strap body 44 may be considered to have assumed an attached configuration relative to the shell 12.

The second strap body 46 is similar to the first strap body 44 and includes an inner surface 86 and an opposing outer surface 88, and is comprised of a primary panel 90, a first mounting segment 92, a second mounting segment 94. The second strap body 46 may additionally include a first mounting slot 96 and a second mounting slot 98, both of which extend completely between the inner and outer surfaces 86, 88. First and second mounting strips 100, 102 are connected to the primary panel 90, and third and fourth mounting strips 104, 106 are connected to the first and second mounting segments 92, 94, respectively. The primary panel, first mounting segment, and second mounting segment of the first and second strap bodies 44, 46 are similar, and thus, the above discussion of those structures in relation to the first strap body 44 also applies to those same structures in relation to the second strap body 46. Similarly, attachment of the second strap body 46 to the shell 12 via its first and second mounting segments proceeds in a similar manner to that described above in relation to attachment of the first strap body 44 to the shell 12.

The primary distinction between the first and second strap bodies 44, 46 is in relation to the chin strap segments. The chin strap segment 54 on the first strap body 44 is an elongated strip, the second strap body 46 includes a chin strap segment 108 that is a shorter extension from the primary panel 90 and includes a slot 110 formed therein. The first chin strap segment 54 is sized and configured to be extended through the slot 110 on the second chin strap segment 108, and then folded back over itself to engage with itself via hook and loop fasteners, or other fasteners known in the art. Thus, when the first and second strap bodies 44, 46 are attached to the shell 12, and the first and second chin strap segments 54, 108 are connected to each other, they may collectively define a continuous strap that extends from one side of the shell 12, under the wearer's chin, and to the other side of the shell 12. As such, the shell 12 may be secured to the wearer's head and prevented from inadvertent removal therefrom. The arrangement of the first and second chin strap segments 54, 108 allows for adjustability to accommodate wearers that have different sized heads. For smaller heads, the first chin strap segment 54 may have a greater degree of overlap when connected to itself than when used with a wearer having a larger head. To remove the helmet 10 from the wearer's head, a user may detach the first strap body 44 from the second strap body 46 by unfastening the first chin strap segment 54, and removing it from the slot 110 in the second chin strap segment 108.

According to one embodiment, the helmet 10 may include a plurality of pads attachable to the shell 12 to provide protection over the user's ear, as well as over the rear portion of the user's jaw. In the exemplary embodiment, a first lateral pad 18*a* is connected to the first strap body 44 and a second lateral pad 18*b* is connected to the second strap body 46. Each lateral pad 18 may be formed Ethylene-vinyl acetate (EVA) foam, or other foams or materials known in the art. In one embodiment, the lateral pads 18 may be of a density that is less than 2 pounds-per-square-inch (psi) at 25% compression. An outer layer of fabric may extend over at least a portion the EVA foam, although in other embodiments, the EVA foam may be exposed. The lateral pads 18 may be permanently mounted to the respective strap bodies 44, 46 via an adhesive or the like, or alternatively, the lateral pads 18 may be removably mounted to the strap bodies 44, 46. For instance, hook and loop fasteners or other fasteners known in the art may be used to removably mount the lateral pads 18 to the respective strap bodies.

Each lateral pad 18 may be specifically sized and structured to be complementary in shape to an outer contour of the shell 12 such that when the pad 18 is positioned adjacent the shell 12, the pad 18 may circumferentially engage the shell 12. Along those lines, each pad 18 may include an outer surface 112, an inner surface 114, and a peripheral sidewall 116 extending between the outer surface 112 and the inner surface 114. Each pad 18 may additionally include a central opening 118 extending completely between the outer surface 112 and the inner surface 114. The shape of the central opening 118 may be similar to the shape of the openings formed on the first and second strap bodies 44, 46. The central openings on the pads 18 as well as the strap bodies 44, 46 may be sized and configured to provide a clear path to the wearer's ear when wearing the helmet 10.

At least a portion of the peripheral sidewall 116 may be complementary in shape to a portion of the bottom surface 30 of the shell 12. More specifically, the bottom surface 30 may define a pair of lateral contours on respective sides of the shell 12. Each lateral contour may be defined by a first side segment 120 (e.g., a generally horizontal segment) and a second side segment 122 (e.g., a generally vertical segment). The second side segment 122 may extend from the first side segment 120 such that the first and second side segments 120, 122 collectively define a generally concave configuration. The peripheral sidewall 116 of each pad 18 may be similarly configured and include a first segment 124 and a second segment 126, with the first segment 124 being complementary in size and shape to the first side segment 120, and the second segment 126 being complementary in size and shape to the second side segment 122. Furthermore, the first and second segments 124, 126 of the peripheral sidewall 116 may define a convex configuration that is complementary to the concave configuration of the bottom surface 30.

The first and second lateral pads 18*a*, 18*b* may be sized and configured and connected to the respective strap bodies 44, 46 such that connection of the first strap body 44 and second strap body 46 to respective side regions 28 of the shell 12 positions the first and second lateral pads 18*a*, 18*b* adjacent the shell 12. More specifically, when the first and second strap bodies 44, 46 assume the attached configuration, the first segments 124 of the lateral pads 18 may be positioned adjacent the first side segments 120 of the bottom surface 30, and the second segments 126 of the lateral pads 18 may be positioned adjacent the second side segments 122 of the bottom surface 30.

The helmet 10 may additionally comprise at least one inner pad 128 connectable to the inner surface 20 of the shell 12. The exemplary embodiment includes a single inner pad 128 having a plurality of arms 130 that extend over respective portions of the inner surface 20 of the shell 12. Each arm 130 may include an attachment mechanism 132, such as a strip of hook and loop fastening material, which may be used to secure the arm to the inner surface 20 of the shell 12. In this regard, a complementary attachment mechanism may be coupled to the inner surface 20 of the shell 12 to engage with the attachment mechanism 132 located on the arm 130. The inner pad 128 may be formed from foam or other materials known in the art. The inner pad 128 may provide a comfortable fit to the wearer, and may also be used to size the helmet 10 to fit the head of the wearer. In this regard, inner pads 128 that vary in thickness may be used to provide a suitable fit for the wearer.

It is contemplated that other inner pads that differ in configuration from that shown in the Figures may be used without departing from the spirit and scope of the present disclosure. For instance, the inner pads may include one or more pads that may form a circle or partial circle that extends over or around the user's head. In one embodiment, an upper circular pad may be connected to the interior of the shell 12 at the inside of the crown region, so as to form a halo over the user's head. A lower pad may extend on the inside of the shell 12 from one side, across the back, and to the other side. The lower pad may include one or more circular elements integrated therein, such as a first side circular element, a second side circular element, and a rear circular element.

The helmet 10 can be used in when playing football, particularly in passing leagues, or flag football leagues, which are not full contact leagues. Various implementations of the helmet 10 may also be used in rugby, soccer, lacrosse, field hockey, skiing, skateboarding, bicycle riding, or other sports and activities where protection of the head may be of concern.

Due to the wide-ranging use of the helmet 10, it is contemplated that certain features on the helmet 10 may be customizable based on the intended use. For instance, when used in playing football, it may be desirable to include the lateral pads 18 as part of the helmet 10. However, if the helmet 10 were used when skateboarding, the lateral pads 18 may be not be required or desired. Therefore, to customize the helmet 10 from a football configuration (e.g., lateral-pad configuration) to a skateboarding configuration (e.g., lateral-pad removed configuration) the strap bodies 44, 46 and the corresponding pads 18 may be removed from the shell 12 and replaced with strap bodies 44, 46 that may be smaller/narrower and that do not engage with lateral pads 18. In this regard, the smaller strap bodies may simply connect to the shell 12 and to the other strap body, and extend under the user's chin to retain the shell 12 on the user's head. Conversely, to go from the skateboarding configuration to the football configuration, the narrower strap bodies 44, 46 may be removed from the shell 12, and replaced with the larger strap bodies 44, 46 and the lateral pads 18. Thus, the protective features, qualities and characteristics of the helmet 10 may be seamlessly adapted depending on the desired use of the helmet 10.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A helmet comprising:

a shell having an inner surface and an outer surface, the inner surface defining a cavity sized to receive a head of a user, the shell being formed from a resilient material, the shell having a first shell slot extending from the outer surface of the shell toward the inner surface of the shell;

a first chin strap panel connectable to the shell, the first chin strap panel having a first panel slot formed therein; and a first mounting segment coupled to the first chin strap panel and configured to be advanceable through both the first shell slot and the first panel slot to facilitate connection of the first chin strap panel to the shell.

2. The helmet recited in claim 1, wherein:

the shell further includes a second shell slot extending from the outer surface of the shell toward the inner surface of the shell, the second shell slot being spaced from the first shell slot;

the first chin strap panel further includes a second panel slot formed therein; and the helmet further comprising a second mounting segment coupled to the first chin strap panel in spaced relation to the first mounting segment, the second mounting segment being configured to be advanceable through both the second shell slot and the second panel slot to facilitate connection of the first chin strap panel to the shell.

3. The helmet recited in claim 2, wherein the shell includes a third shell slot extending from the outer surface of the shell toward the inner surface of the shell, the helmet further comprising:

a second chin strap panel connectable to the shell, the second chin strap panel having a third panel slot formed therein; and a third mounting segment coupled to the second chin strap panel and configured to be advanceable through both the third shell slot and the third panel slot to facilitate connection of the first chin strap panel to the shell.

4. The helmet recited in claim 3, wherein the first chin strap panel is configured to be connectable to the second chin strap panel.

5. The helmet recited in claim 4, wherein the first chin strap panel includes an elongate segment and the second chin strap panel includes a connection slot, the elongate segment being advanceable through the connection slot to facilitate interconnection between the first chin strap panel and the second chin strap panel.

6. The helmet recited in claim 1, wherein the resilient material is expanded polypropylene (EPP) foam.

7. The helmet recited in claim 1, wherein the resilient material is of a density between 1.5-2.5 pound-force per cubic foot (pcf).

8. The helmet recited in claim 1, further comprising a first pad coupled to the first chin strap panel.

9. The helmet recited in claim 8, wherein the first pad is configured to include a portion being complementary in shape to a portion of the shell.

10. The helmet recited in claim 8, wherein the first pad is formed from Ethylene-vinyl acetate (EVA) foam.

11. The helmet recited in claim 8, wherein the first pad includes a central opening formed therein.

12. The helmet recited in claim 1, further comprising at least one vent opening formed in the shell.

13. A helmet comprising:

a shell having an inner surface and an outer surface, the inner surface defining a cavity sized to receive a head of a user, the shell having a plurality of shell slots extending from the outer surface of the shell toward the inner surface of the shell; and a chin strap assembly connectable to the shell, the chin strap assembly including a pair of chin strap panels and a pair of chin strap mounting segments extending from respective ones of the pair of chin strap panels, each chin strap panel having a panel slot formed therein, each mounting segment being advanceable through a respective one of the plurality of shell slots and a respective panel slot to facilitate connection of the chin strap assembly to the shell.

14. The helmet recited in claim 13, wherein the pair of strap panels are configured to be connectable to each other.

15. The helmet recited in claim 14, wherein one of the pair of strap panels includes an elongate segment and the other of the pair of strap panels includes a connection slot, the elongate segment being advanceable through the connection slot to facilitate interconnection between the pair of strap panels.

16. The helmet recited in claim 13, wherein the shell is formed from expanded polypropylene (EPP) foam.

17. The helmet recited in claim 13, wherein the shell is formed from a resilient material that is of a density between 1.5-2.5 pound-force per cubic foot (pcf).

18. The helmet recited in claim 13, further comprising a pair of pads connectable to respective ones of the pair of chin strap panels.

19. The helmet recited in claim 18, wherein each pad is configured to include a portion that is complementary in shape to a portion of the shell.

20. The helmet recited in claim 18, wherein each pad is formed from Ethylene-vinyl acetate (EVA) foam.

* * * * *